United States Patent [19]

Scarzella

[11] 4,434,875

[45] Mar. 6, 1984

[54] EMERGENCY LEVELLING DEVICE FOR A LIFT CAR

[76] Inventor: Sergio Scarzella, Corso Taranto 130/A, Torino, Italy

[21] Appl. No.: 376,980

[22] Filed: May 10, 1982

[30] Foreign Application Priority Data

May 12, 1981 [IT] Italy ..... 67635 A/81

[51] Int. Cl.[3] ..... B66B 5/02

[52] U.S. Cl. ..... 187/29 R; 187/29 A

[58] Field of Search ..... 187/29

[56] References Cited

U.S. PATENT DOCUMENTS

| | | | |
|---|---|---|---|
| 2,701,033 | 2/1955 | Chiselbrook | 187/29 |
| 3,144,917 | 8/1964 | Tressel | 187/29 |
| 3,469,657 | 9/1969 | Sgroi | 187/29 |
| 3,532,186 | 10/1970 | Swartzell | 187/29 |
| 3,706,357 | 12/1972 | Simpson | 187/29 |

*Primary Examiner*—J. V. Truhe
*Assistant Examiner*—W. E. Duncanson, Jr.
*Attorney, Agent, or Firm*—Sughrue, Mion, Zinn, Macpeak & Seas

[57] ABSTRACT

An emergency device for bringing a lift car (10) to a level in the event of an unwanted stoppage in a different position from a normal stop level ($L_n$) comprises an auxiliary hydraulic motor (30) with a reversible sense of rotation arranged to operate the winch (20) of the lift through a control system which may be manual or automatic. The control system includes a hydraulic accumulator (38) connected to the hydraulic motor (30) through valve means (54) and selector means (69) for controlling the sense of rotation of the hydraulic motor (30), actuator means (54; 152; 184) for controlling the opening of the valve means (54), and means (86; 164) for indicating the position of the lift car (10) and position sensor means (128; 176) which are displaceable relative to each other in synchronism with the movement of the lift car (10) and cooperate with the selector means (69) to bring the lift car (10) to a level by moving it in the more convenient direction to reach one of the normal stop levels ($L_n$).

16 Claims, 16 Drawing Figures

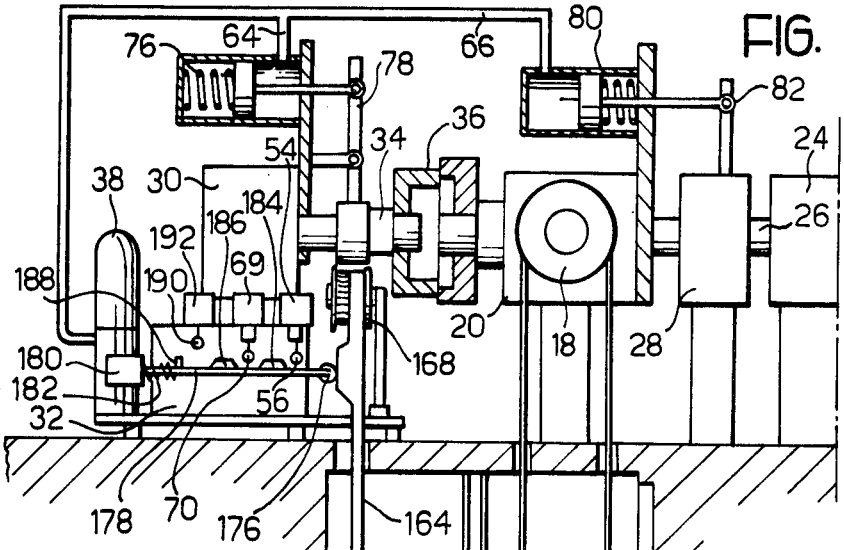
FIG. 9
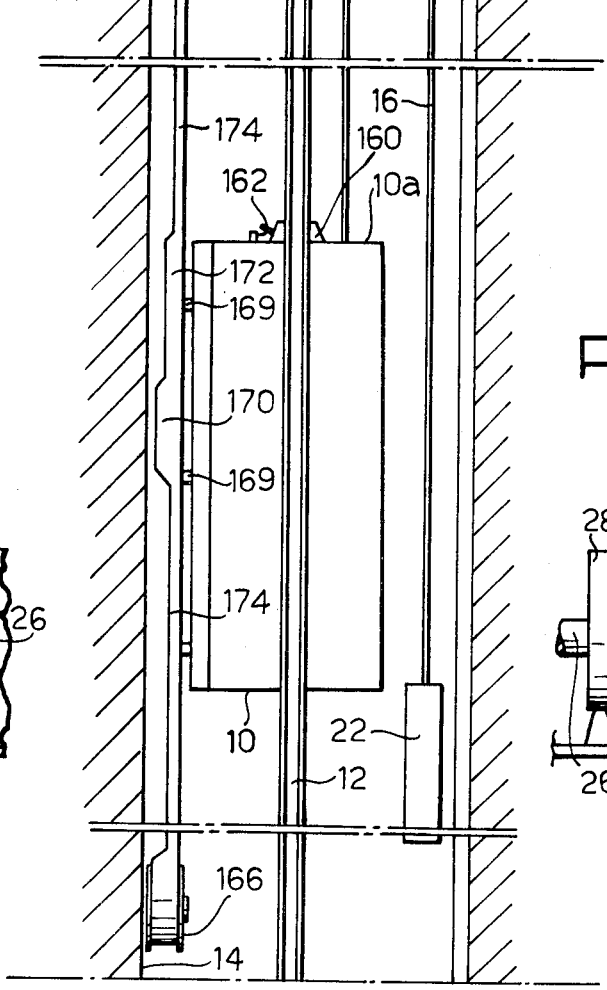
FIG. 15
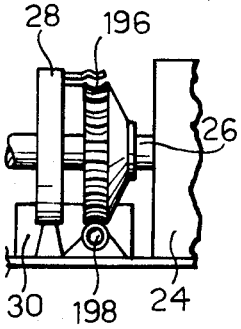
FIG. 16
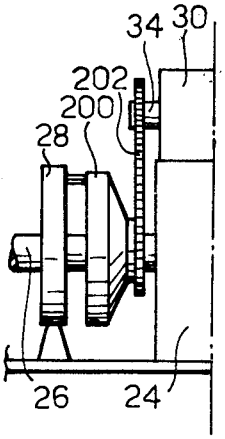

EMERGENCY LEVELLING DEVICE FOR A LIFT CAR

The present invention relates generally to lifts which are driven by a winch controlled by an electric motor and having an associated emergency brake, and is concerned particularly with emergency devices for bringing the lift car to a level in the event of an unwanted stoppage thereof in a position different from the normal stop levels. Such emergency levelling devices are intended to prevent the lift occupants becoming trapped if the electric motor breaks down or the supply to the motor is cut off.

Known devices of this type usually include an auxiliary motor which can be coupled to the winch, means for releasing the emergency brake of the lift, and means for controlling the operation of the brake release means and the auxiliary motor to bring the lift to one of the normal stop levels in the case of an unwanted stoppage of the car in a position different from these levels.

In these known devices, the auxiliary motor is generally an electric motor supplied by an independent electrical source, such as a battery, the operation of which is controlled through an electrical circuit terminating at a control located within the lift car.

This solution has the disadvantage of poor reliability and of requiring frequent checking and maintainance, since the battery is subject to rapid deterioration. Similar devices are described, for example, in French Pat. Nos. 1,465,733 and 1,526,795.

Emergency levelling sysems have also been proposed which use an auxiliary winch driven pneumatically or hydraulically and installed directly on the lift car, and the operation of which is controlled from inside the car through an electrical circuit (see, for example, French Pat. No. 1582521).

Not even these solutions ensure different reliability and, above all, are relatively complicated.

The main object of the present invention is that of avoiding the aforementioned disadvantages and of producing an emergency levelling device for a lift car which allows high levels of reliability and safety to be ensured.

Another object of the invention is to provide an emergency levelling device which is arranged to operate without the aid of a battery-type supplementary electrical supply.

A further object of the invention is to provide a levelling device which is able to operate to bring the lift to one of the normal stop levels not only when the electric motor breaks down or the electrical supply is cut off, but also in the case of the lift over-running beyond a normal stop level or in the case of a drop caused by an excessive speed of descent.

Another object of the invention is that or providing an emergency levelling device which, in all the cases mentioned above, allows the lift car to be brought to a level by means of a displacement in the more convenient direction to reach one of the normal stop levels.

A further object of the invention is to provide an emergency levelling device which may conveniently be applied to existing lifts and which may easily be adapted to the various current safety standards in the field.

Another object of the invention is that of providing an emergency levelling device which is able to operate both as a result of a manual command given by the occupant of the lift car and completely automatically should one of the aforementioned events occur.

These objects are achieved by virtue of the fact that, according to the invention, the emergency levelling device for a lift car is characterised in that the auxiliary motor is a hydraulic motor having a shaft with a reversible sense of rotation arranged to operate the winch, and the means for controlling the operation of the hydraulic motor include:

- a hydraulic control circuit including a hydraulic accumulator for operating the hydraulic motor, valve means for controlling the communication between the hydraulic accumulator and the hydraulic motor, and selector means interposed between the valve means and the hydraulic motor for controlling the sense of rotation of the shaft of the hydraulic motor;
- actuator means for controlling the opening of the valve means, and
- means for indicating the position of the lift and position sensor means cooperating with each other and displaceable relative to each other in synchronism with the movement of the lift, the position sensor means being operatively connected with the selector means to control automatically the sense or rotation of the shaft of the hydraulic motor and the resulting movement of the lift car in the more convenient direction to reach one of said normal stop levels.

According to a first embodiment of the invention, the position indicator means are stationary and are located laterally of and parallel to the path of displacement of the lift car, and the position sensor means are carried by the lift car.

According to this solution, the device includes manual control means located in the lift car to control the operation of the actuator means and the position sensor means mechanically.

According to another embodiment of the invention, the position indicator means are movable with the lift car and the position sensor means are independent of the lift car.

In this case, the device includes automatic control means for operating the actuator means and the position sensor means as a result of a stoppage of the electric motor.

The invention will now be described in detail with reference to the appended drawings, provided purely by way of non-limiting example, in which:

FIG. 9 is a view similar to FIG. 1 of a variant of the invention;

FIGS. 15 and 16 are two schematic elevational views illustrating two variants of a part of the device according to the invention.

Figure 1:
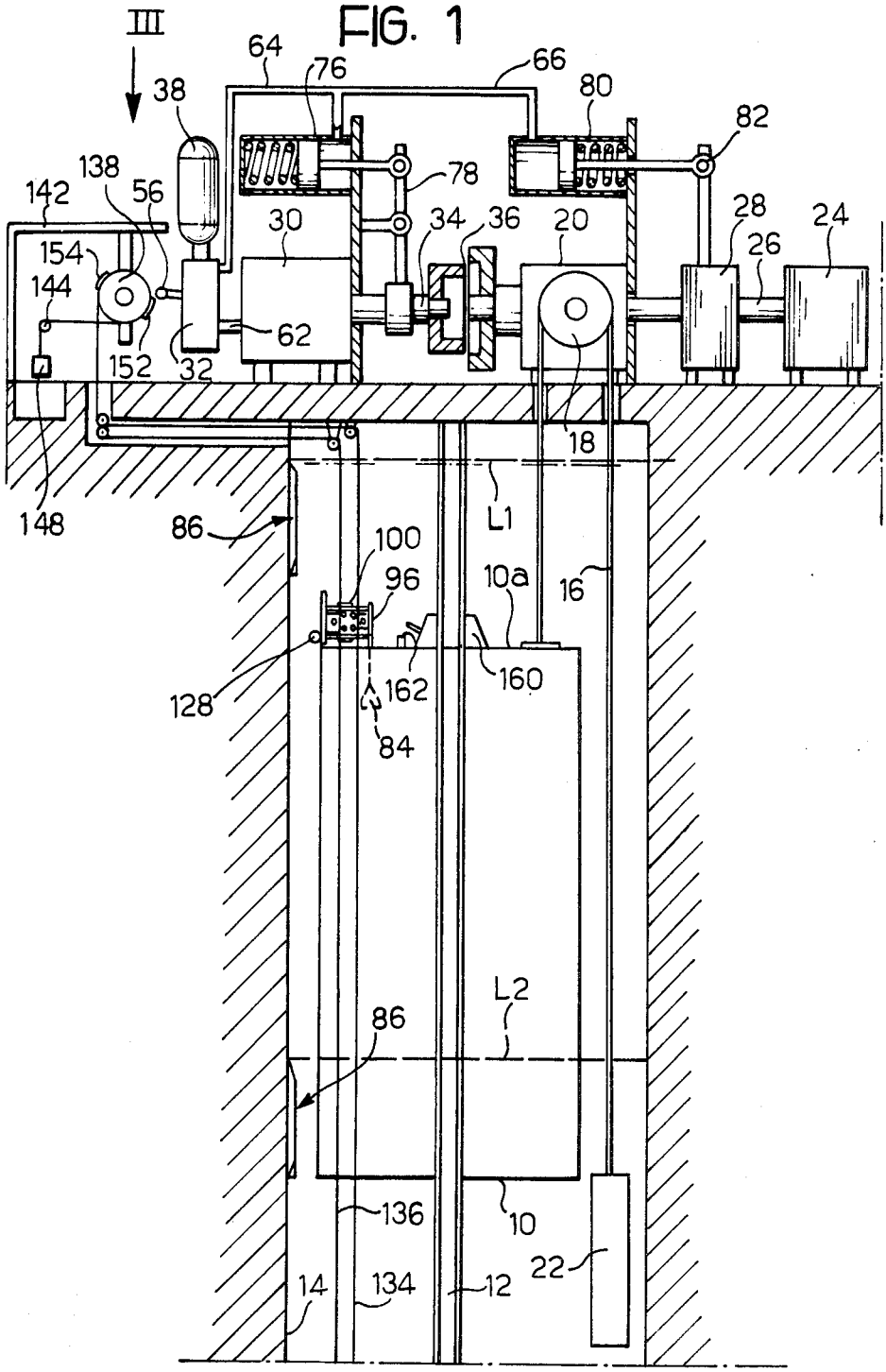
FIG. 1 is a schematic, partially sectioned, elevational view of a lift provided with an emergency levelling device according to a first embodiment of the invention.

Referring initially to FIG. 1, a lift car 10 is movable vertically along guides 12 within a lift shaft 14, between a plurality of successive normal stop levels $L_1$, $L_2$, . . . $L_n$.

The movement of the car 10 is controlled by one or more cables 16 which are wound on a drum 18 of a winch 20 and are anchored at one end to the roof 10*a* of the car 10 and at the opposite end to a counterweight 22.

The winch 20 is located above the lift shaft 14 and is driven by an electric motor 24 and the shaft 26 of which is connected to an emergency brake 28, usually of the electromagnetically-controlled shoe type, which is actuated by a stoppage of the motor 24.

Figure 2:
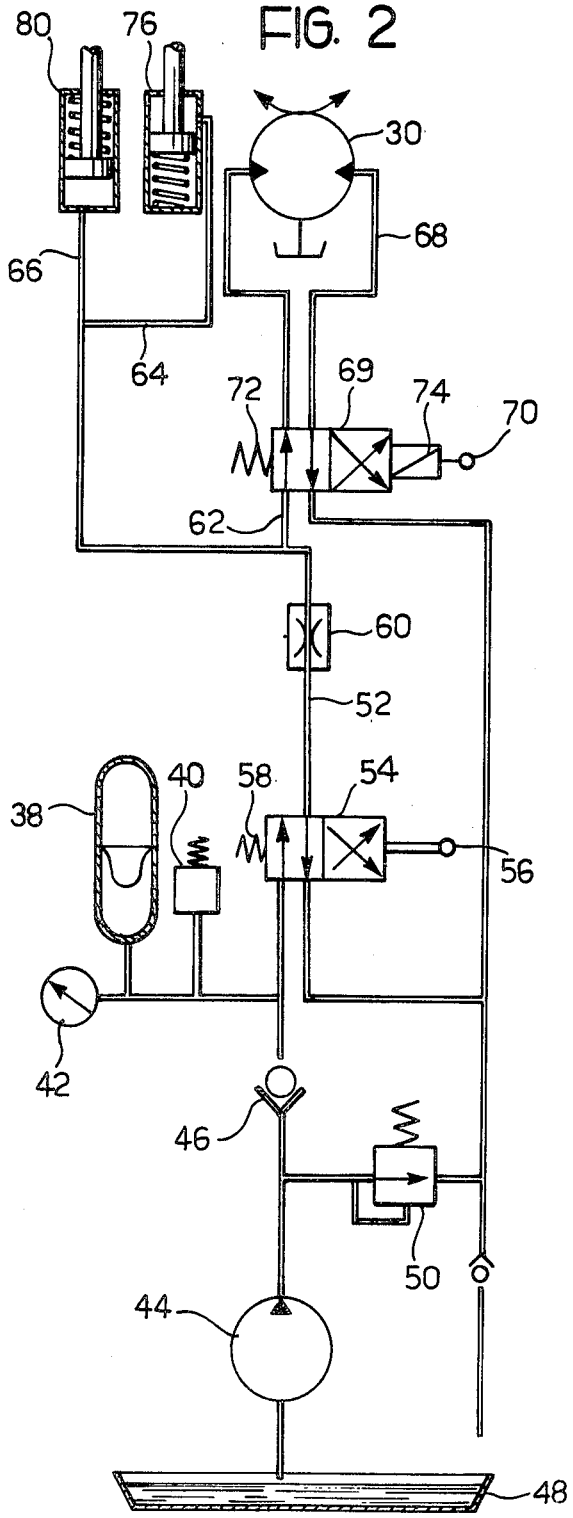
FIG. 2 is a diagram of the hydraulic control circuit for the levelling device.

An auxiliary hydraulic motor 30 with a reversible sense of rotation is connected to an hydraulic control circuit 32 (FIG. 2). The shaft 34 of the motor 30 is adapted for connection to the winch 20 by means of a friction clutch 36.

Referring to FIG. 2, the hydraulic control circuit 32 includes a hydraulic accumulator 38, to which are connected a thrust meter 40 and a pressure gauge 42, connected to an electric recharging pump 44 for supplying liquid from a storage vessel 48 through a non-return valve 46. Between the electric pump 44 and the non-return valve 46 is a bypass duct in which is connected an over-pressure valve 50 for returning any excess liquid to the vessel 48.

The hydraulic accumulator 38 is connected to a main pipeline 52 in which is connected a three-way valve 54 displaceable, by means of a control member provided with a feeler roller 56 and against the action of a return spring 58, between two extreme positions in the first of which (Illustrated in FIG. 2) communication between the accumulator 38 and the pipeline 52 is cut off, and in the second of which this communication is open.

The pipeline 52, in which a flow regulator 60 is connected, branches into three secondary pipes 62, 64, 66 respectively.

The pipe 62 is connected to one side of the hydraulic motor 30 the opposite side of which is connected to a pipe 68 which, in turn, terminates in the storage vessel 48. Within the pipes 62, 68 is connected a selector or four-way distributor 69 displaceable, by means of a control member provided with a feeler roller 70 and against the action of a return spring 72, between two extreme positions in the first of which (illustrated in FIG. 2) the sense of rotation of the hydraulic motor 30 corresponds to the downward movement of the car 10, and in the second of which the sense of rotation of the motor 30 corresponds to the upward movement of the car 10. These two positions will be termed the "descent position" and the "ascent position" respectively below.

An electromagnetic actuator 24 is also connected to the selector 69, which operates, controlled in the manner described below, to displace the selector 69 from the descent position to the ascent position independently of control by the roller 70.

The two pipes 64, 66 are connected respectively to a first hydraulic actuator 76 arranged to control the engagement of the friction clutch 36 by means of a transmission 78, and a second hydraulic actuator 80 arranged to control the release of the emergency brake 28 through a transmission 82. It should be noted that the second actuator 80 could be removed and replaced by a mechanical transmission, for example, a cable transmission, controlled directly by the hydraulic actuator 76. In each case, the arrangement must be such that the engagement of the friction clutch 36 corresponds to the release of the emergency brake 28.

In the embodiment illustrated in FIG. 1, the control of the valve 54 and the selector 69 is achieved, as follows, by the manual operation of a control handle 84 within the car 10.

Figure 8:
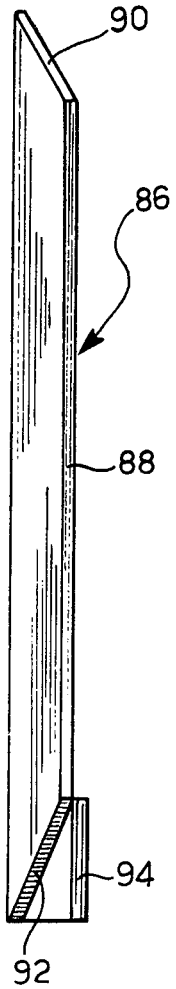
FIG. 8 is a perspective view of a detail of the device.

Within the lift shaft 14 are fixed a series of cams 86 which are spaced apart parallel to the direction of movement of the car 10, the number of cams corresponding to the number of normal stop levels $L_n$. Each of the cams 86 extends from one of these levels towards the next level down for a length substantially less than half the distance between these two levels. As shown in greater detail in FIG. 8, each cam 86 has a flat active surface 88 arranged parallel to the direction of movement of the car 10 and has upper and lower inclined ends in the form of ramps 90, 92 respectively. At the side of the ramp 92 at the lower end is provided a bearing surface 94 which extends parallel to and at the same level as the active surface 88.

Figure 4:
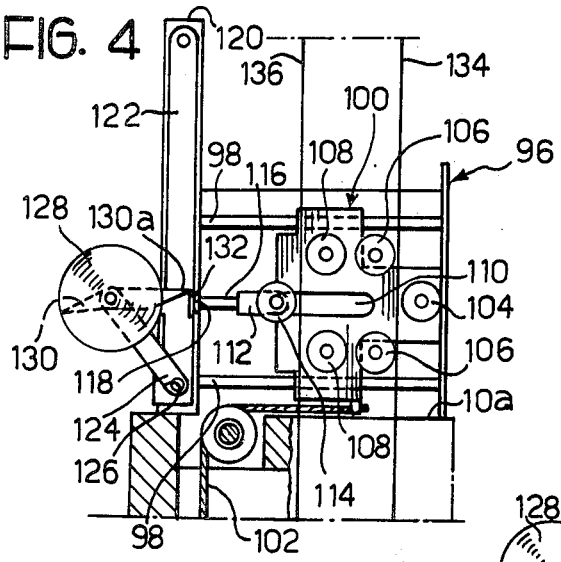
FIGS. 4 to 7 illustrate a component of the emergency levelling device in four different possible operative conditions.

As is clearly seen in FIG. 4, a support and guide structure, generally indicated 96, is fixed to the roof 10*a* of the car 10 and includes two horizontal guide bars 98 which are placed one above the other and face the wall of the lift shaft 14 on which the cams 86 are fixed. An assembly 100 mounted for sliding movement along the two guides 98 is connected to the control handle 84 by means of a flexible cable 102 and carries a first engagement roller 104 for cooperating with a pair of first opposing rollers 106 fixed to the structure 96, and a pair of second engagement rollers 108 staggered relative to the rollers 106 towards the cams 86.

A longitudinal slot 110 is formed in the movable assembly 100 and is open towards the cams 86, a slider 112 carrying a second opposing roller 114 being slidably mounted in the slot. The slider 112 is rigid with a shaft 116 provided at its free end with a rounded head 118 movable through a vertical support 120 of the structure 96. A pivoting lever 122 which bears laterally against the head 118 is articulated to the upper end of the vertical support 120, and to the lower end of this lever is articulated a shorter pivoting lever 124. In the position illustrated in FIG. 4, the lever 124 is inclined relative to the lever 122 towards the cams 86 and bears against an inclined lateral stop surface 126 formed close to the lower end of the lever 122.

At the end of the lever 124 opposite the end articulated to the lever 122 are rotatably mounted a feeler roller 128 and, to the side of this, a retaining member 130 in the form of a parallelogram. As is clearly seen in FIG. 4, the retaining member 130 is, in effect, constituted by a lever which is unbalanced with respect to its articulation on the lever 124, such that, in the condition illustrated in this Figure, it is pulled by gravity into a substantially horizontal position with its end 130*a* facing the movable assembly 100 bearing against a stop 132 carried by the lever 122.

The movable assembly 100 cooperates with a pair of flexible ties 134, 136 which extend vertically in the lift shaft 14 at the side of the car 10, on the side corresponding to the cams 86. The two ties 134, 136 are preferably constituted by two metal belts or cables, and are anchored at their lower ends, in a manner not illustrated, to the bottom of the lift shaft 14. The upper ends of the two ties 134, 136 pass over respective idle pulleys and reach a pair of respective take-up rolls 138, 140 supported rotatably by a support structure 142 at the side of the control circuit 32 of the hydraulic motor 30.

Figure 3:
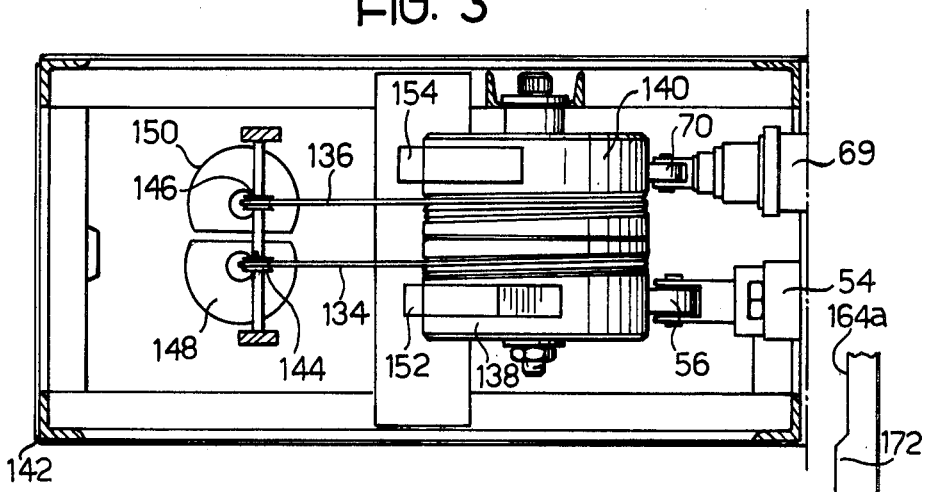
FIG. 3 is a plan view from above on an enlarged scale taken on the line III—III of FIG. 1.

As shown in greater detail in FIG. 3, the two ties 134, 136 are wound on two drums 138, 140 and, passing over respective idle pulleys 144, 146, terminate at two counterweights 148, 150 which ensure the necessary tension in the two ties.

The two drums 138, 140 are provided with respective cams 152, 154 which cooperate with the feeler roller 56 of the valve 54 and the feeler roller 70 of the selector 69 respectively.

As is clearly seen in FIGS. 1 and 4, during the normal operation of the lift, the two ties 134, 136 extend between the engagement roller 104 and the two opposing rollers 106, and between the two engagement rollers 108 and the opposing roller 114, respectively.

If there is an unwanted stoppage of the car 10 in a position different from the normal stop levels $L_n$ due, for example, to a breakdown of the electric motor 24 or an interruption of the electric supply thereto, operation of the handle 84 allows the hydraulic motor 30 to be operated to bring the car 10 to one of the normal stop levels $L_n$ in the direction corresponding to the more convenient movement. This stage will now be described with reference to the three possible conditions illustrated in FIGS. 5, 6 and 7 respectively.

Figure 5:
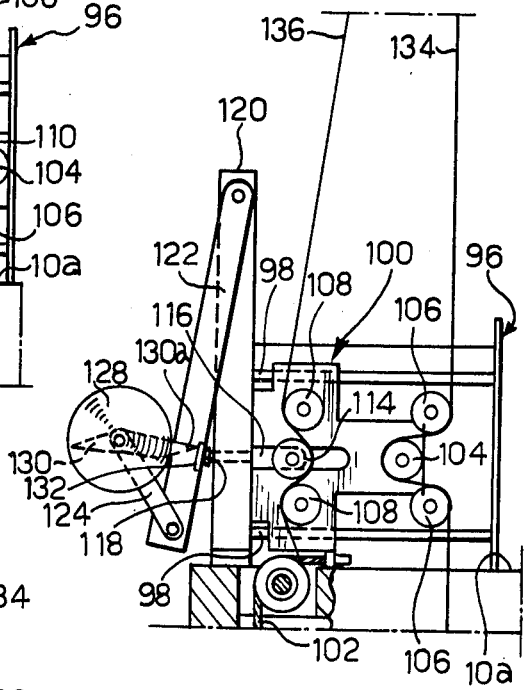

The condition illustrated in FIG. 5 corresponds to a stoppage of the car 10 in a zone between, for example, levels $L_1$ and $L_2$, below the cam 86 associated with the upper level $L_1$. In this case, the pull exerted on the cable 102 by means of the handle 84 causes the advancement of the movable assembly 100 towards the support 120 of the structure 96, and a resulting pull on the two ties 134, 136 which, due to the displacement of the assembly 100, are bent between the rollers 104, 106 and 108, 114 respectively. The pull exerted on the tie 136 causes the advancement of the roller 114 and the shaft 116, and hence the angular outward movement of the pivoting lever 122 carrying the feeler roller 128. This angular movement is made possible by the fact that the cam 86 is displaced vertically relative to the feeler roller 128. As a result, the bending of the tie 136 is minimised in this case. This while the bending of the tie 134 causes a rotation of the respective take-up roll 138 and the consequent bearing of its cam 152 against the feeler roller 56 of the valve 54, the tie 136 is not bent sufficiently to operate the selector 69. The operation of the handle 84 therefore causes the opening of the valve 54, while the selector 69 remains in the descent position shown in FIG. 2. The liquid supplied under pressure from the accumulator 38 thus causes, due to the opening of the valve 54, the engagement of the friction clutch 36, the release of the brake 28, and the actuation of the hydraulic motor 30 so as to lower the car 10 towards the lower level $L_2$. The movement of the car 10 may be stopped manually by releasing the handle 84, or automatically immediately the car 10 has reached the lower level $L_2$. Indeed, in this case, the feeler roller 128 encounters the upper ramp 90 of the corresponding cam 86, causing an angular return of the lever 122 and the resulting return of the slider 112 and the roller 114 relative to the movable assembly 100. This causes a greater pull on the cable 136 and consequently a smaller rotation of the take-up drum 140, whereby the selector 69 is shifted into a neutral position intermediate the two extreme ascent and descent positions, stopping the hydraulic motor 30.

Figure 6:
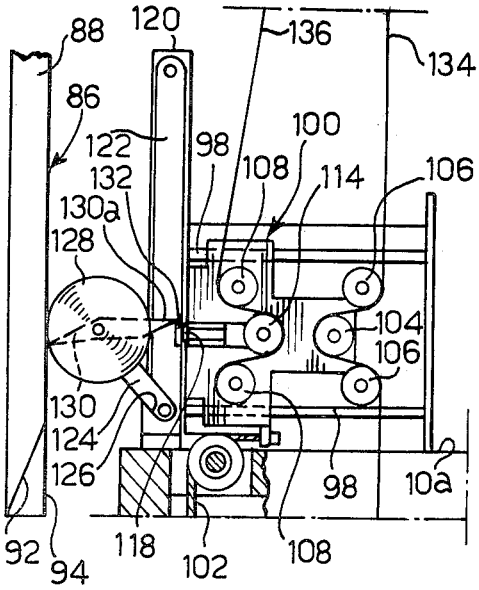

FIG. 6, on the other hand, illustrates the case in which the car 10 stops at a level corresponding to that of the active surface 88 of one of the cams 86. In this case, the displacement of the movable assembly 100, due to the operation of the handle 84, causes a larger bending both of the tie 134 and of the tie 136, which is allowed by the fact that the roller 114 is not able to move in the direction of the cam 86 because the latter bears against the feeler roller 128. As a result, the rotation imparted by the ties 134, 136 to the two drums 138, 140 causes, on the one hand, the opening of the valve 54 and, on the other hand, the displacement of the selector 69 into the ascent position. The car 10 is thus raised towards the upper level $L_1$ and is stopped when the feeler roller 128 encounters the upper ramp 80 of the cam 86.

Figure 7:
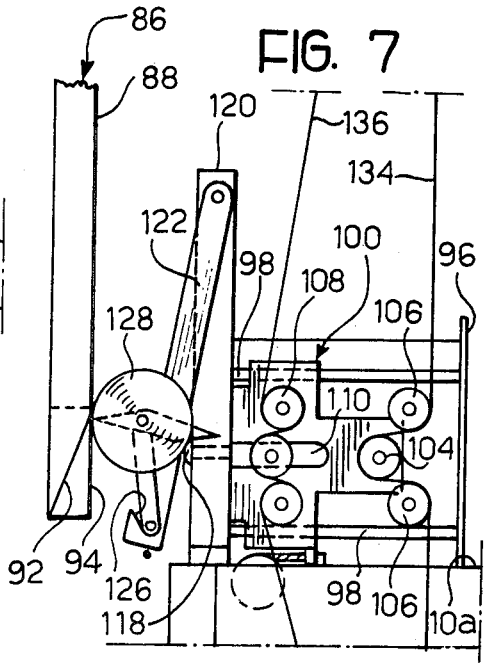

FIG. 7, on the other hand, illustrates the condition of an unwanted stoppage of the car 10 in a position in which the feeler roller 128 faces the ramp 92 at the lower end of one of the cams 86. This situation is more critical in that the operation of the handle 84 and the consequent displacement of the movable assembly 100 might cause the selector 69 to be shifted into a neutral position, that is, into a position intermediate the ascent and descent positions, preventing the operation of the motor. This risk is completely eliminated by the presence of the bearing surface 94 and the retaining member 130. Indeed, the displacement of the movable assembly 100 in this case causes the outer end of the retaining member 130 to bear against the bearing surface 94, achieving the disengagement of the end 130*a* from the stop 132 and allowing the angular return of the pivoting lever 124 relative to the pivoting lever 122. In this condition, the bending of the tie 136 between the rollers 108 and the roller 114 is not sufficient to product an effective rotation of the drum 140, so that the selector 69 remains in the descent position of FIG. 2, and the car 10 may thus be lowered to bring it to the lower stop level $L_2$.

Similar conditions of operation occur in the case of a stoppage of the car 10 beyond the normal stop levels $L_n$ due to over-running as a result of a malfunction of the brake 28.

The electromagnetic actuator 74 associated with the selector 69, on the other hand, acts in the event of the operation of the automatic emergency wedge or vice brake of the car 10, as a result of a drop thereof due, for example, to an excessive speed of descent. The euectromagnetic actuator 74 is connected to the supply of the electric motor 24 through an electric switch 162 controlled by the operation of the emergency brake, indicated schematically 160 in FIG. 1. The operation of the actuator 74, due to the closure of the switch 162, causes an initial shifting of the selector 69 into the ascent position so as to allow an initial upward movement of the car 10, upon operation of the handle 84, which allows the emergency brake 160 to release automatically in a known manner and the resulting reopening of the switch 162. Subsequently, the operation of the handle 84 allows the car 10 to be brought back to the normal, more convenient stopped position in the manner described above.

The variant of the invention illustrated in FIG. 9 is generally like the embodiment described above and only the differences will be described in detail, the same reference numerals being used for identical or similar parts.

This variant differs from the embodiment of FIG. 1 essentially in that the emergency levelling of the car 10 is achieved completely automatically, that is, without any manual operation from inside or outside the car 10.

In this case, the control circuit 32 of the hydraulic motor 30 is entirely similar to that described above, except for the omission of the electromagnetic actuator 74, while the control system of the valve 54 and the selector 69 is different.

Indeed, in this case, the cams 86 fixed within the lift shaft 14 are replaced by an endless belt 164 passing around a pair of pulleys 166, 168 and driven directly from the car 10 through connection means 169. In the example illustrated, the belt 164 extends within the lift shaft 14 at the side of the car 10. However, this belt could be of a compact size, and scale, and be installed completely above the lift shaft 14 in the zone of the lift machinery.

Along one of its longitudinal edges 164*a*, the belt 164 has a series of successive cams corresponding in number to the number of possible normal stop levels $L_n$ of the car 10. Each of the cams is, in effect, defined by a zone of the belt 164 of varying width, each including a wider section 170 corresponding to the position of the car 10 at a normal stop level $L_n$, a section of intermediate width 172 corresponding to a position of the car 10 between this normal stop position and less than half of the height of the distance between this level and the next level down, and a section of smaller width corresponding to the remaining positions of the car 10 between the two successive levels.

The cammed edge 164*a* of the belt 164 cooperates with a feeler roller 176 carried by one end of a shaft 178 movable transversely of the belt 164 and the opposite end of which is fixed to the core of an electromagnetic actuator 180. The latter is connected to the supply circuit for the electric motor 24 so as to be energised during the operation thereof to hold the shaft 178 in a withdrawn rest position, corresponding to the position illustrated in FIG. 11, against the action of a helical spring 182 biassing the shaft 178 axially towards the edge 164*a* of the belt 164.

The shaft 178 is provided with two axially spaced cam members 184, 186 for cooperating with the feeler roller 56 of the valve 54 and the feeler roller 70 of the selector 69 respectively. The shaft 178 is further provided, between the cam member 186 and the actuator 180, with a stop projection 188 arranged to cooperate, in the manner described below, with a movable complementary stop member 190 actuated, by means of an electromagnetic actuator 192 also connected to the supply circuit for the electric motor 24, through the switch 162 operated by the emergency brake 160 of the car 10. In the normal conditions of operation, the actuator 192 keeps the complementary stop 190 in a withdrawn rest position illustrated in FIGS. 9 to 12, in which it does not interfere with the stop 188.

Figure 11:
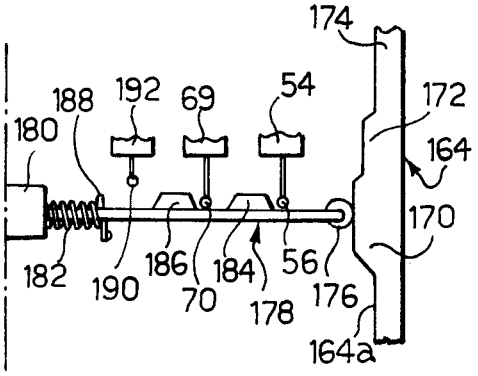

During the normal operation of the lift, the shaft 178 is maintained in the position illustrated in FIG. 11, with the two cam members 184, 186 staggered relative to the feeler rollers 56, 70. Thus, in this condition, the hydraulic motor remains inoperative.

A similar situation occurs in the case of an unwanted stoppage of the car 10 due, for example, to a breakdown of the electric motor 24 or an interruption of its supply, exactly in correspondence with one of the normal stop levels $L_n$. In this case, the shaft 178, which is freed by the actuator 180 and urged by the spring 182 against the edge 164*a* of the belt 164, is maintained in a withdrawn position due to the bearing of the feeler roller 176 against the wider section 170 of the corresponding cam.

Figure 10:
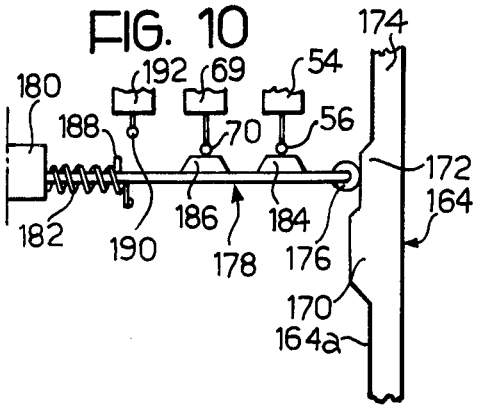

FIG. 10 illustrates, on the other hand, the case in which an unwanted stoppage of the car 10 occurs in a zone between one of the normal stop levels and less than half the distance between this level and the next level down. In this case, the shaft 178, which is freed by the actuator 180 and urged by the spring 182, stops in the position corresponding to the bearing of the feeler roller 175 against the intermediate-width section 172 of the corresponding cam. In this case, the cam members 184, 186 cooperate with the feeler rollers 56, 70 to cause the opening of the valve 54 and the shifting of the selector 69 into the ascent position, respectively. Thus, the hydraulic motor 30 is actuated to raise the car 10 to a corresponding normal stop level. Immediately this level is reached, the shaft 178 is brought into the condition of FIG. 11, stopping the hydraulic motor 30.

Figure 12:
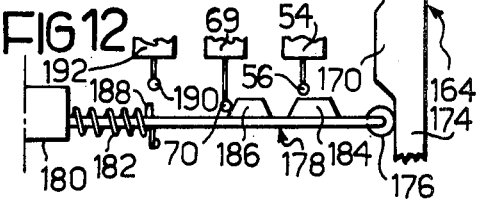
FIGS. 10 to 14 illustrate a detail of FIG. 9 on an enlarged scale in five different possible operative conditions.

FIG. 12 illustrates, on the other hand, the situation corresponding to an unwanted stoppage of the car 10 in a position between one of the normal stop levels and less than half the distance between this level and the next level down. In this case, the shaft 178 lies in a position such that the cam member 184 interferes with the feeler roller 56 to cause the opening of the valve 54, while the cam member 186 is displaced relative to the feeler roller 70. The selector 69 thus remains in the descent position and the hydraulic motor 30 drives the winch 20 to lower the car 10 to the lower normal stop position. When this level is reached, the shaft 178 is brought into the position of FIG. 11 so as to stop the hydraulic motor 30.

Figure 13:
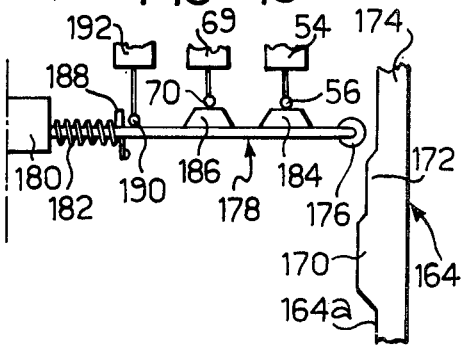

FIG. 13 illustrates the case of a stoppage of the car 10 as a result of the operation of the emergency brake 160. The action of the latter, through the closure of the switch 162, causes the operation of the actuator 192 and the displacement of the complementary stop 190 towards the shaft 178. The displacement of the latter towards the belt 164 is opposed by the interengagement of the two stops 188, 190 in a position corresponding to that of FIG. 10, so as to achieve an initial stage of raising of the car 10 and allow the release of the emergency brake 160. As a result of this release, the actuator 192 brings the complementary stop 190 into a rest position and the shaft 178 may advance against the edge 164*a* of the belt 164 to effect the automatic levelling of the car 10 in the manner described above.

Figure 14:
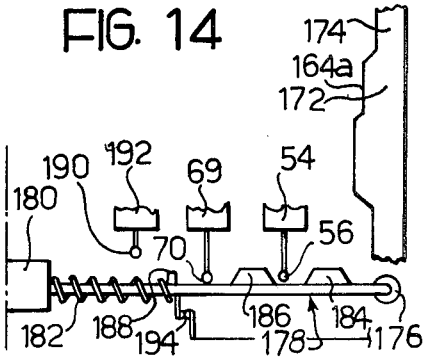

FIG. 14 illustrates a critical situation corresponding to a breakage of the belt 164 with the car 10 located in correspondence with one of the normal stop positions. For this case, an electrical switch 194 is provided which operates a cut-off device for the motor 24, the operation of the device being controlled by the additional movement of the shaft 178 under the action of the spring 182 in the de-energised condition of the actuator 180. Naturally, in this condition, the cam members 184, 186 are staggered with respect to the feeler rollers 56, 70 of the valve 50 and the selector 69.

The two embodiments described above provide for the release of the emergency brake 28 of the lift simultaneously with the operation of the hydraulic motor 30. In several installations with reversible-type winches 20, however, the release of the emergency brake is prohibited when the electric motor 24 is inactive.

In these cases, two variants of the connection between the hydraulic motor 30 and the winch 20 are envisaged, which are illustrated respectively in FIGS. 15 and 16, wherein the friction clutch 36 with its hydraulic actuator 76 and the actuator 80 for controlling the release of the brake 28 are eliminated.

In the case of FIG. 15, the braking members of the brake 28 are coupled to a helically-toothed gear wheel 196 which is meshed with a worm gear 198 rotated by means of the hydraulic motor 30. In the case of FIG. 16, the braking members of the brake 28 are coupled to a support 200 mounted on the shaft 26 of the electric motor 24 and are connected to the shaft of the hydraulic motor 30 by means of a belt or chain transmission 202. In both cases, the operation of the hydraulic motor 30 rotates the shoes of the brake 28 together with the shaft 26 of the electric motor 24 through the worm gear 198, and through the transmission 202, respectively.

Naturally, the details of construction and forms of embodiment of the invention may be varied widely from that described and illustrated without departing from the scope of the present invention as defined in the following claims. Thus, for example, the position indicator means of the lift car and the position sensor means may clearly be constituted by electrical, magnetic or electro-optical devices which are functionally equivalent to those described above. These devices could naturally be connected to an auxiliary electrical supply circuit and the control of the valve 54 and the selector 69 would, in this case, be achieved by means of electrically controlled actuators.

I claim:

1. Emergency levelling device for a lift car (10) operated by a winch (20) driven by an electric motor (24) and having an associated emergency brake (28), including an auxiliary motor having an output shaft, means for coupling the output shaft of the auxiliary motor to the winch (20), means for releasing the brake (28), and means for controlling the operation of the release means of the brake (28) and the auxiliary motor in the event of an unwanted stoppage of the lift car (10) in a position different from the normal stop levels ($L_n$), to bring the lift car (10) to one of said levels ($L_n$), characterised in that the auxiliary motor is a hydraulic motor (30) having a shaft (34) with a reversible sense of rotaion and the means for controlling the operation of hydraulic motor (30) include:

an hydraulic control circuit (32) including a hydraulic accumulator (38) for operating the hydraulic motor (30), valve means (54) for controlling the communication between the hydraulic accumulator (38) and the hydraulic motor (30), and selector means (69) interposed between the valve means (54) and the hydraulic motor (30) for controlling the sense of rotation of the shaft (34) of the hydraulic motor (30);

actuator means (56, 152; 184) for controlling the opening of the valve means, and means (85; 164) for indicating of the position of the lift car (10) and position sensor means (128; 176) cooperating with each other and displaceable relative to each other in synchronism with the movement of the lift car (10), the position sensor means (128; 176) being operatively connected to the selector means (69) to control automatically the sense of rotation of the shaft (34) of the hydraulic motor (32) and the resulting movement of the lift car in the more convenient direction to reach one of said normal stop positions ($L_n$).

2. Device according to claim 1, characterized in that the position indicator means (86) are stationary and are located laterally of and parallel to the path of movement of the lift car (20), and in that the position sensor means (128) are carried by the lift car (10).

3. Device according to claim 1, characterised in that the position indicator means (164) are movable with the lift car (10) and the position sensor means are independent of the lift car (10).

4. Device according to claim 1 or claim 2, characterised in that it includes manual control means (84) located in the lift car (10) for controlling mechanically the operation of the actuator means (56;152) and the position sensor means (128).

5. Device according to claim 1 or claim 3, characterised in that it includes automatic control means (178,180,182) for operating of the actuator means (56,186) and the position sensor means (176) as a result of a stoppage of the electric motor (24).

6. Device according to claim 1, characterised in that the valve means comprise a valve (54) movable between two extreme positions in the first of which communication between the hydraulic accumulator (38) and the hydraulic motor (30) is cut off and in the second of which this communication is open, and the selector means include a four-way distributor (69) which is interposed between the valve (54) and the hydraulic motor (30) and is movable between two extreme positions corresponding to the two opposite senses of rotation of the shaft (34) of the hydraulic motor (30).

7. Device according to claim 2, characterised in that the position indicator means comprise a series of cams (86) spaced apart parallel to the direction of movement of the lift car (10), the number of cams corresponding to the number of possible normal stop levels ($L_n$), each of the cams (86) having an elongate form parallel to the direction of movement of the lift car (10) and extending from one of these levels ($L_n$) towards the next level down for a length of substantially less than half the distance between these two levels, and in that the actuator means and the position sensor means include an assembly (100) carried on the upper part of the lift car (10) and movable between a withdrawn rest position and an extended working position in which it projects towards the cams (86), and manual control means (84) accessible from inside the lift car (10) for controlling the displacement of the movable assembly (100) from the rest position to the working position.

8. Device according to claim 7, characterised in that the actuator means include first and second flexible ties (134, 136) which extend at the side with the cams (96) for substantially the entire length of the path of movement of the lift car (10), the two flexible ties (134,136) being anchored at their lower end and being disposed along the path of movement of the movable assembly (100), and a pair of rotatable drums (138,140) on each of which is wound the upper end of one of the two ties (134,136), the two drums (138,140) being provided with cam means (152,154) for actuating the valve means and the selector means (69) respectively, and in that the movable assembly (100) includes first engagement means (104,106), second engagement means (108,114) and feeler means (128) associated with the second engagement means and arranged to cooperate with the cams (86), the first and second engagement means being independent of each other and being arranged to exert respectively a lateral pull on the first tie (134) due to the displacement of the movable assembly (100) into the working position, and on the second tie following the displacement of the movable assembly (100) into the working position and due to the effect of the bearing of the feeler means (128) against one of the cams (86), so as to rotate the respective drums (138,140) and consequently actuate, by means of the cam means (152,154) thereof, the valve means (54) and the selector (69).

9. Device according to claim 8, characterised in that the movable assembly (100) and the cams (86) are provided with cooperating means (122,124,130,94) arranged to prevent the positioning of the selector means (69) in a neutral position intermediate the extreme positions corresponding to the two opposite senses of rotation of the shaft (34) of the hydraulic motor (30), when the feeler roller (128) is positioned at the ends (92) of the cams (86) opposite the corresponding normal stop levels ($L_n$) with which these cams (86) are associated.

10. Device according to claim 7, in which the lift car (10) is provided with automatic wedge-or vice-type emergency braking means (160) arranged to operate in the event of a drop of the lift car (10), characterised in that the selector means (69) are connected with an electromagnetic drive member (74) connected to the supply circuit for the electric motor (24) and arranged to position the selector means (69) in the position in which the sense of rotation of the shaft (34) of the hydraulic motor (30) corresponds to the raising of the lift car (10), and in that the emergency braking means (160) are operatively connected with an actuator (162) arranged to operate the electromagnetic drive member (74).

11. Device according to claim 3, characterised in that the position indicator means comprise an endless belt (164) which is rotated by the movement of the lift car (10) and has a series of successive cams along one of its longitudinal edges (164*a*), the same number of cams corresponding to the number of possible normal stop levels ($L_n$) of the lift car (10), each of the cams being defined by a zone of the belt of varying width, each including a wider section (170) corresponding to the position of the lift car (10) at a normal stop level ($L_n$), a section of intermediate width (172) corresponding to a position of the lift car (10) between this normal stop level and less than half the distance between this level and the next level down, and a narrower section (174) corresponding to the remaining positions of the lift car (10) between this level and the next level down, and in that the actuator means and the position sensor means comprise:

a movable shaft member (178) located at the side of the belt (164) and having a feeler roller (176) at one end arranged to cooperate with the longitudinal edge (164*a*) of the belt (164), the movable member (178) being displaceable between a withdrawn rest position in which the feeler roller (176) is spaced from the belt (164) and an advanced operative position in which the feeler roller (176) is in contact with the said edge of the belt, drive means (180) associated with the end of the movable shaft member (178) opposite the feeler roller (176) for automatically effecting its displacement from the rest position to the operative position as a result of a stoppage of the electric motor (24) of the lift, and cam means (184,186) carried by the shaft member (178) for operating the valve means (54) and the selector means (69).

12. A device according to claim 11, characterised in that the drive means are constituted by an electromagnetic actuator (180) connected to the supply circuit of the electric motor (24) of the lift and arranged to maintain the shaft in the withdrawn position, in the operative condition of the electric motor (24), against the action of resilient means (182) biassing the shaft (178) towards the advanced position.

13. A device according to claim 2, in which the lift car (10) is provided with automatic wedge- or vice-type emergency braking means (160) arranged to operate automatically in the event of a drop of the lift car (10), characterised in that the shaft member (178) is provided with a stop member, and in that the emergency braking means (160) are operatively connected with a complementary stop member (190) displaceable, upon operation of the emergency braking means (160), from from a withdrawn rest position to an advanced operative position such that the cam means (184,186) place the valve means (54) and the selector means (69) in the position in which the sense of rotation of the hydraulic motor (30) corresponds to the raising of the lift car (10).

14. A device according to claim 1, characterised in that between the hydraulic motor (30) and the winch (20) is interposed a clutch member (36) which is normally disengaged and is associated with a hydraulic engagement device (76) connected to the hydraulic control circuit (32) downstream of the valve means (54), so that the operation of the hydraulic motor (30) corresponds to the engagement of the clutch member (76).

15. A device according to claim 14, characterised in that release means for the emergency brake (28) include an actuator (80) which is arranged to control the opening of the braking members of the brake (28) and is coupled operatively with the hydraulic engagement device (86) of the clutch member (36), so that the operation of the clutch member (36) corresponds to the release of the emergency brake (28).

16. A device according to claim 1, characterised in that it includes transmission means (196,198; 200,202) directly connecting the shaft (34) of the hydraulic motor (30) and the braking means of the emergency brake (28).

* * * * *